US006629566B2

(12) United States Patent
Liknes

(10) Patent No.: US 6,629,566 B2
(45) Date of Patent: Oct. 7, 2003

(54) METHOD AND APPARATUS FOR REMOVING WATER FROM WELL-BORE OF GAS WELLS TO PERMIT EFFICIENT PRODUCTION OF GAS

(75) Inventor: Alvin Liknes, Calgary (CA)

(73) Assignee: Northern Pressure Systems Inc., Calgary (CA)

( * ) Notice: Subject to any disclaimer, the term of this patent is extended or adjusted under 35 U.S.C. 154(b) by 0 days.

(21) Appl. No.: 09/879,944

(22) Filed: Jun. 14, 2001

(65) Prior Publication Data

US 2002/0007953 A1 Jan. 24, 2002

(51) Int. Cl.[7] ..... E21B 43/00; E21B 43/12; E21B 34/10

(52) U.S. Cl. ..... 166/372; 166/325; 166/328; 166/332.8

(58) Field of Search ..... 166/372, 369, 166/250.15, 325, 328, 332.8, 90.1

(56) References Cited

U.S. PATENT DOCUMENTS

| | | | | | |
|---|---|---|---|---|---|
| 2,061,865 | A | * | 11/1936 | Wells | 166/149 |
| 2,391,542 | A | * | 12/1945 | Benard | 417/143 |
| 3,797,968 | A | | 3/1974 | Elfarr | |
| 3,894,583 | A | | 7/1975 | Morgan | |
| 3,894,814 | A | | 7/1975 | Morgan | |
| 3,963,377 | A | * | 6/1976 | Elliott et al. | 417/384 |
| 3,991,825 | A | * | 11/1976 | Morgan | 166/106 |
| 4,171,016 | A | | 10/1979 | Kempton | |
| 4,226,284 | A | | 10/1980 | Evans | |
| 4,265,312 | A | | 5/1981 | Thein | |
| 4,437,514 | A | | 3/1984 | Canalizo | |
| 4,465,435 | A | * | 8/1984 | Copas | 417/56 |
| 4,509,599 | A | | 4/1985 | Chenoweth et al. | |
| 4,596,516 | A | | 6/1986 | Scott et al. | |
| 4,823,880 | A | | 4/1989 | Klatt | |
| 5,141,406 | A | * | 8/1992 | Ream | 417/145 |
| 5,211,242 | A | * | 5/1993 | Coleman et al. | 166/106 |
| 5,339,905 | A | | 8/1994 | Dowker | |
| 5,501,279 | A | * | 3/1996 | Garg et al. | 166/168 |
| 5,806,598 | A | * | 9/1998 | Amani | 137/155 |
| 5,911,278 | A | * | 6/1999 | Reitz | 166/372 |
| 5,957,199 | A | * | 9/1999 | McLean et al. | 166/250.15 |
| 6,138,758 | A | * | 10/2000 | Shaw et al. | 166/105.5 |
| 6,298,918 | B1 | * | 10/2001 | Franco et al. | 166/105.6 |
| 6,352,109 | B1 | * | 3/2002 | Buckman, Sr. | 166/107 |

FOREIGN PATENT DOCUMENTS

| | | |
|---|---|---|
| CA | 848766 | 8/1970 |
| CA | 890226 | 1/1972 |

OTHER PUBLICATIONS

Society of Petroleum Engineers website http://speonline.spe.org/tigs3/coiltube/ , Coiled Tubing Applications Glossary, p. 6 of 32.*

Edward J. Hutlas, William R. Granberry A Practical Approach to Removing Gas Well Liquids SPE–AIME, Amoco Production Co. (Aug. 1972).

* cited by examiner

*Primary Examiner*—David Bagnell
*Assistant Examiner*—T. Shane Bomar

(57) ABSTRACT

Method and apparatus for removing water from a gas well to permit efficient production of gas while protecting formation from introduced pressures. The apparatus comprises a one-way-valve that seals the casing from production zone when hydrostatic pressure of water from production accumulates in casing above production perforations and one-way-valve exceeds formation pressure. When the casing is sealed, a compressor pressurizes gas into the casing but not an exhaust conduit, the top of the casing being sealed around the exhaust conduit, permitting communication between the conduit and a suitable destination, such as via liquid separators on into sale pipeline. Accumulated water is caused to flow into the bottom of the exhaust conduit and out at surface to collection. When pressure within the sealed casing to the top end of exhaust conduit is equalized, the one-way-valve opens and regular production can resume.

15 Claims, 2 Drawing Sheets

METHOD AND APPARATUS FOR REMOVING WATER FROM WELL-BORE OF GAS WELLS TO PERMIT EFFICIENT PRODUCTION OF GAS

FIELD OF INVENTION

This invention relates to an improved method and apparatus for the removal of water from the well-bore of gas wells so as to reduce the hydro static head associated with the produced water and to thus unload the well and permit more efficient production of gas.

BACKGROUND OF THE INVENTION

Numerous gas wells in Alberta, Canada, and throughout the world, produce a minimum of natural gas because of problems associated with water produced with the gas, which accumulates at bottom-hole, and by virtue of its weight provides a hydrostatic back pressure which partially or entirely defeats the ability of formation gas pressure to move well gas to the surface for collection.

There are a number of methods in use to remove water from the well-bore of a producing gas well when the column height of water in the bore produces a hydrostatic pressure greater than the pressure of the gas from formation sufficient to impair production.

The gas in those situations has typically been produced out of a smaller diameter tubing string inserted into the well because the smaller cross-section of the tubing produces higher velocities of gas flow at formation pressures which it is hoped will carry the water out of the well-bore during production and thus "unload" the well.

As a reference, the article "A Practical Approach to Removing Gas Well Liquids" written by E. J. Hutlas and W. R. Granberry (published August 1972 in *Journal of Petroleum Technology*) discusses the history of methods of removing unwanted accumulations of liquids from gas wells. The article states that the best methods for removing liquid from producing gas wells are pumping units, (for shallow fields having very low pressure), liquid diverters, intermitters and gas lifts (for deeper higher-pressure fields), and inserted tubing strings for wells where severe formation damage could result from stopping operations (e.g. well shock).

U.S. Pat. No. 4,265,312 to Thein, METHOD FOR DEVELOPING WATER WELLS, issued May 5, 1981, pertains to a method of developing a water well, but is instructive in that it deals with the introduction of a gas-lift water pump into a well-bore, the pump's action being provided by introduction from surface of high-pressure gas (air, in that case) in an inner tube deployed such that its bottom end is above the bottom end of an outer tube in which the inner tube is centered, and the bottom of both of which tubes are deployed submersed in the well-bore's accumulated water. The pressured gas escapes from the bottom of the inner tube and is collected and exits the well-bore, rising up through the annulus between the pressurized tubing and the second, outer tube, taking with it entrained water from the wellbore (within which the tubes were deployed).

In the Thein patent, the purpose was to provide a gas-lift pumping means with some agitation at the well-bore's bottom end to remove settled solids and improve water flow within a water well. The apparatus is a good example of a form of gas-lift pump (concentrically deployed tubing strings, providing pressurized gas from surface to the inner tube, permitting gas and entrained liquids to exit using the annulus between inner and outer tube as a discharge path).

There are two related prior art downhole pump systems, U.S. Pat. Nos. 3,894,583 and 3,894,814 to Morgan, both issued Jul. 15, 1975, titled ARTIFICIAL LIFT FOR OIL WELLS, which describe a two-chamber down-hole pump apparatus to be removably inserted into an oil well's casing to pump oil from an oil well where production pressure is insufficient to provide lift to surface.

Morgan's '583 patent describes an apparatus and system where the well's casing is isolated by a packing from the production zone and from the pump at bottom-hole to provide a storage tank for compressed air, an accumulator below the packing to collect oil from formation via a check valve which is vented to surface, said vent line being periodically pressurized by connecting tubing and valves to the casing's stored pressurized air to force the collected oil from the accumulator up a secondary tubing string to surface. A piston, pig or swab is deployed below the oil in the production tubing string. The vent/pressure tubing is deployed adjacent/concentrically to said production tubing. Crossover conduits between production tubing/venting tubing are used to switch annulus mid-bore. An electric switch/ball float is deployed in the lower well-bore to sense the accumulator's state (full or not), and to energize an air pump top-hole and electrically switched valves to pressurize the vent tubing.

Morgan's '814 patent describes and claims the same system and apparatus, absent the use of the upper casing as a pressure tank and requiring an electrically actuated 3-way valve and down-hole sensor.

Morgan's '583 patent also describes an embodiment where the accumulator means is formed by a chamber comprised of the well's casing below the packer isolating the upper casing's compressed air storage area from production, and also below a second packer below the perforations in the casing to formation, with a check valve from the thereby isolated production zone of the casing into the accumulator chamber below said second packer, said production and vent tubing extending in a sealed way through both packers and into the accumulator zone.

In U.S. Pat. No. 3,797,968 to Elfarr, issued Mar. 19, 1974 APPARATUS FOR FLOWING LIQUID FROM A WELL, describes a downhole siphon pump apparatus for producing oil from an oil well where formation pressure is insufficient to move oil from bottom-hole to surface, powered by compressed gas from surface. The Elfarr system is comprised of two concentrically deployed tubing stings inserted within the well's casing. The inner tubing string for its length to near bottom carries compressed gas from surface. The annulus between the two tubing strings carries oil from the bottom-hole pump to surface. Near the bottom, the conduits cross-over via cross-over passages in a fitting. At various heights in the production annulus, check valves are deployed to permit upward-only flow of oil. At bottom, a check valve permits oil from the formation in the casing to enter the outer conduit and accumulate in the tubing string's outer annulus. A check valve in the bottom of the inner tubing string, below cross-over and above the lower check valve is deployed permitting oil to flow upward only into the production passageway for pumping. The inner tubing at surface can be pressurized, causing the pressure differential across the check valves at bottom to (a) close communication between the two tubing strings and the casing; and (b) open communication between inner and outer conduits, permitting and causing the accumulated captured oil to flow upward toward the surface. The formation is thus not exposed to higher than bottom-hole ambient pressure. The check valves in the outer production annulus and the system can be cleared by removal of the inner tubing string, which is for most of its length (from surface to cross-over) used only to carry pressurized gas from the surface.

There is thus formed a pump with two chambers deployed up-hole, formed of concentric-tubing strings, cross-over fittings, and check valves, with the removable inner string sitting on nipples and seats on the inner surface of the outer tubing string, for pumping oil from wells using introduced pressurized gas from surface. The pump was designed to move oil to surface in an oil well to enhance production, but it is complex, small-diameter, and requires specialty fittings, seats and nipples, and it has a large number of complex and special-purpose valves. It would interfere significantly with free gas-flow, and while it operates on pressure differentials (a siphon-like function), it is for the specific purpose of pumping oil to surface.

U.S. Pat. No. 4,509,599 to Chenoweth et al, GAS WELL LIQUID REMOVAL SYSTEM AND PROCESS, issued Apr. 9, 1985, describes a system and apparatus for dewatering a gas well which, at the well-bore's bottom end has collected sufficient fluid (water, for example) that the bottom-hole pressure (adjacent the production from formation to casing) is insufficient to independently transport gas from formation to surface (through, it is assumed, a conduit or tubing string secondary to the casing's cross-section).

Chenoweth's invention provides for the division of the casing's annulus into two independent conduits (typically, a tubing string and the casing/tubing annulus), with a compressor at surface producing lower pressure within one of the conduits sufficient that production pressure (from formation) at bottom-hole propels gas-fluid mixture to surface through that low-pressure conduit, permitting gas alone to flow through the other conduit (once the over-pressure situation has been remedied by removal of sufficient fluid from the well's bottom). There is also provided a means of heating the top segment of the mixed fluid-gas-carrying conduit to avoid precipitation of paraffin.

It is a necessary part of the Chenoweth invention that both conduits communicate with formation throughout the process claimed. It is also provided that a lowered pressure (partial vacuum) is applied, at surface, which can be difficult, and which might damage the well's production interface. It does not contemplate any need to segregate production zones from the method or apparatus for dewatering the well. It is a "closed" system in that all matter exhausted from the wellbore is (once liquids are separated) inserted into the gas collection system to the sales line.

The discussion in the prior art cited in the Chenoweth specification discloses the insertion of highly pressurized gas into a well-bore to cause the evacuation of gas and liquid from well-bottom through a second "siphon tube" string to "unload" a gas well, as well as methods involving gas-lift valves, downhole mechanical pumps, differential gas intermitter systems, and the like, and claims to overcome the difficulties inherent in those systems. Of particular interest here is the mention of insertion of high pressure gas to "blow" liquid-gas mixtures up a siphon tube depended within the well's casing, as a variant to reduction of pressure from collection system pressure ranges to lower, atmospheric pressure ranges, in order to exhaust gas through the siphon tube at high enough velocities to unload the problematic well.

The cure in the objects of the Chenoweth '599 patent for damage potential from highly pressurizing the casing (and production formation) is to significantly reduce the pressure through the siphon tubing, thus permitting formation pressures to be the highest pressures in the system (and thus eliminating formation damage potentials caused by insertion of high pressure gas from surface into casing, which can "drive" entrapped liquids and solids at bottom-hole in the well-bore back through the casing perforations into formation).

U.S. Pat. No. 4,437,514 to Canalizo DEWATERING APPARATUS, issued Mar. 20, 1984, discloses a valve-set comprised of two valves, one permitting liquid-only fluid flow from casing-tubing annulus into tubing, the other, higher, valve permitting communication from casing-tubing annulus of gas or liquid into the tubing. The valve-set is put at the lower end of a tubing string, and may be actuated automatically or from surface.

During operation, when the well-bore begins to fill with water from production, the water rises within the casing-tubing annulus, and when its hydrostatic pressure is sufficient to open the lower valve, water is made to enter the tubing string. When the tubing string is filled to a desired level, the second, higher, valve is opened, and the tubing, being open to atmosphere at surface, is over pressured by pressure of produced gas and liquids, which thus enter the bottom of the tubing string and cause a gas bubble to enter and to evacuate water and gas to surface, optionally with the use of a pig or plunger between the gas and trapped water. This may be referred to as a gas-lift intermitter.

When suitably evacuated, the pressure in the casing-tubing annulus will have dropped, it being sealed at surface with collection tubing with a third check (one-way out) valve, which causes the second, higher valve to close, shutting off produced pressure to the tubing.

There is no need to insert additional pressure to the casing-tubing annulus, nor is any method disclosed. There is no seal of the well-bore above production, as there is no introduced pressure to damage the producing formation. A problem which the '514 system will encounter in deep wells is that the longer length tubing introduces more chances of the equipment binding in the tubing string.

U.S. Pat. No. 4,226,284 to Evans, GAS WELL DEWATERING METHOD AND SYSTEM, issued Oct. 7, 1980, provides for a closed system of pipes and valves operable via a timer, which permits casing pressure to dewater a gas well by blowing produced gas down an inserted tubing string using pipeline or formation pressure, so that entrained water with produced gas is blown back up the casing/tubing annulus directly into a conventional production collection system (which typically includes a normal gas flow line and liquid separator means), in order not to waste produced gas in the dewatering process.

Otherwise, the Evans invention shows no increase in casing pressure, nor any method of protecting the formation, the inventive step being the closed piping and valve system with timer. Energy is provided again from pipeline or production pressure to the lift mechanism.

Canadian Patent No. 848,766 to Kelley and Kelley, LIQUID CONTROL FOR GAS WELLS, issued Aug. 11, 1970, discloses an apparatus to control the liquid depth in gas and oil wells. This invention is comprised of a positive action liquid/gas separator within a well-bore, a tubing string within the well-bore connected to the separator, a gas lift valve connected to the tubing string and responsive to predetermined pressure (supplying gas under pressure from the well-bore to the tubing string so it lifts liquid through the tubing string to the surface), and a free piston member (or pig or swab) retained within the tubing string for movement between the gas lift valve and the surface below the column of liquid (to assist the gas lift in driving the column of liquid from the well by segregating the water above the lift gas).

Canadian Patent No. 890,226 to Kelley and Kelley, APPARATUS FOR REMOVING LIQUID GAS FROM AND OIL WELLS, issued Jan. 11, 1972, discloses an apparatus for the removal of liquid from gas and oil wells. This invention is similar to Canadian Patent No 848,766 absent the liquid-gas separator but with the addition of a self-lubricating free piston member (to replace the free piston member). The invention shows an intermitter gas lift with a free piston. The free piston is disposed in the tubing string and retained by a bottom stop and catcher apparatus, and is lifted by introduced gas from formation below the column of liquid to distribute the pressure of gas admitted to the tubing string by the gas lift device across the bottom of the column of liquid and to avoid the gas dissolving in the liquid as it is lifted to lower pressure regions. This invention provides automatically regulated intermittent flow through the tubing string without manual control or cycle timers. This invention and Canadian Patent No. 848,766 require relatively high inherent (not introduced) differential gas pressures to operate reliably.

U.S. Pat. No. 5,339,905 to Dowker, GAS INJECTION DEWATERING PROCESS AND APPARATUS, filed November 1992, discloses a gas injection dewatering process and apparatus. In this invention a conduit is provided in a watered-in well in the form of tubing of smaller diameter than the well-bore or cased bore to conduct water from the bottom of said well-bore to the surface, said conduit including a check check-valve such that when water flows upward, it cannot then reflux backward.

Periodically, a volume of dried, pressurized natural gas is injected into the lower end of the conduit from an adjacent gas line from surface and which injected gas is then allowed to expand, thereby forcing a slug or column of water upward through the conduit toward the upper end. This is a typical "gas lift" method.

This "pulse" of induced gas is repeated, being pumped periodically down the secondary conduit through the well-bore or casing through that conduit, and then being allowed to expand within the production tubing conduit in order to cause a pulse of increased pressure within the production conduit which is meant to cause the water into which that conduit is depended to be forced to surface.

In one embodiment, there are two conduits deployed essentially in parallel down the well-bore's length from surface to below water, with one being an exhaust conduit and the other being a delivery system for the pressurized dehydrated natural gas, where the said dehydrated natural gas is injected into the body of the exhaust conduit, thus causing a "bubble" of expanding gas to flow upwardly within the said exhaust conduit, decreasing pressure within the exhaust conduit and thus pulling water up the exhaust conduit coupled with pulses of expanding gas.

There are a number of difficulties with this system, chief amongst them being that by pressurizing the well-bore to force water up the conduit this method also can cause the pressure within the formation with which it is in communication to increase, and incidentally causing the water (and any included matter) accumulated in the well-bore to be forced back into the formation, together with any sand or other substance in the well's bore at bottom-hole near the casing, and thus "reloading" and potentially damaging the formation, rather than evacuating the accumulated water at bottom hole.

Additionally, this invention requires special equipment to provide dehydrated natural gas under pressure, and requires the deployment of specialized dual/parallel tubing and injector mechanisms, thus being more costly than desired.

U.S. Pat. No. 4,823,880 to Klatt, GASWELL DEHYDRATOR VALVE, filed September 1988, discloses a gas well dehydrator valve. This invention deals with the particular situation of two contiguous producing gas zones within one well-bore, both being produced simultaneously, the lower one through a tubing dependent past a segregation packer in the well-bore between the two zones. When the upper producing zone produces sufficient water such that the hydrostatic pressure caused by that water's accumulation above the segregation packer within the well-bore overloads the production from that upper zone, this invention's system provides for a special valve within the packer to allow communication of the gas under higher pressure from the lower formation to be introduced to the annulus between the inner conduit and the well's casing, where the upper production is done and where there is now water accumulated, in order to use that introduced gas pressure to essentially "pump" or "blow" said accumulated water up that annulus to surface, reducing the hydrostatic pressure and unloading the upper formation, allowing production from the upper reservoir to resume under natural pressure (when the specialized packer-valve is reset).

This invention has a number of particular deficiencies, notably: the requirement for two contiguous production zones, the lower zone not accumulating water from formation (i.e. maintaining its natural pressurization sufficient to clear the accumulated water in the upper zone); the requirement for specialized and complex valve and actuation devices at the segregation packer and the packer itself, together with difficulties inherent in properly locating and sealing those apparatus properly in the well-bore.

U.S. Pat. No. 4,171,016 to Kempton, WATER REMOVAL SYSTEM FOR GAS WELLS, filed February 1978, discloses a water removal system for gas wells. This invention involves a set of concentrically deposed tubes with a specialized injector at the bottom end within a well-bore, depending into water at the well-bore's bottom. Pressurized water is pumped down the annulus between the inner tube's outer wall and the outer tube's inner wall, and is injected at bottom upwardly into the inner tube's annulus, causing said water to jet under significant pressure up the inner tube, which in turn causes the pressure within the inner tube to drop somewhat from the pressure within the formation, and thus causing the water within the well-bore to flow or be thus pumped to surface. This is a down-hole injection or jet pump.

There are a number of difficulties with this system and method, chief among those being the requirement to pump large volumes of water at relatively high pressures into the well-bore near the formation in order to cause sufficient jet-pumping pressure differentials to evacuate the water from near to the formation. Additionally, if the injector becomes damaged or clogged, this system will result in additional volumes of water being introduced to the production zone of the well under high pressure, thus potentially seriously damaging that well's future ability to produce gas.

U.S. Pat. No. 4,596,516 to Scott et al, GAS LIFT APPARATUS HAVING CONDITION RESPONSIVE GAS INLET VALVE, issued Jun. 24, 1986, discloses a gas lift where a siphon tube is deployed within the well's casing, and near the bottom end of the siphon tube is a valve, operable from surface (or alternatively, responsive to the differential between hydrostatic pressure of a column of water within said annulus and the pressure within the siphon tubing), which, when opened, permits communication from the casing's annulus outside of the siphon tubing with the interior of the siphon tubing.

The valve structure is sealed to the casing (below the communications openings) by a set of two packings, situated above the perforations from formation to the casing's annulus. The seals or packings are provided with a pipe which (full-time) communicates from formation to the casing's annulus, said pipe extending within said annulus upward from the packing to above the operative parts of said valve.

When the wellbore including the casing annulus and the tubing string (siphon) are filled with produced water, and it seems desirable to evacuate said water, the valve within the tubing is opened, permitting produced gas from formation to enter said valve above the packing seals, and to enter the siphon tubing, causing a bubble of produced gas to "burp" up the tubing, and evacuate water therefrom to surface (with the optional assistance of a piston-like "pig" which travels above the gas slug but below the moved liquid to surface, where the liquid is drained off and the pig is permitted to descend the tubing to bottom).

There is provided no means of fully sealing the wellbore just above casing perforation to protect the production formation during pressurizing of the well. Formation pressure, when introduced through the novel valve/seal means, is sufficient to provide gas-lift to evacuate water without adding or inserting pressure to casing.

This, then, is a typical downhole valve system of evacuating water from a producing gas well's bore using a second tubing string and production pressures and gases to provide necessary lift.

OBJECTS OF THE INVENTION

It is an object of this invention to overcome or mitigate as many of the difficulties apparent in the prior art as is workable.

SUMMARY OF THE INVENTION

This invention is a system and apparatus for the removal of water from a gas well.

The present invention overcomes or mitigates some shortfalls in the prior art, chiefly those which concern potential damage to producing formation or to the wellbore and casing from injected pressurized fluid or gas to power pump or lift devices, the insertion of pressure into the well-bore which could communicate either directly or via pressure conveyed through fluid and gas in the well-bore to the production formation, or similar problems. As well, the present invention provides an efficient system of dewatering and thus unloading a watered-in gas well with locally obtained pressurized gas using facilities, materials and equipment which are conventionally available and easy to operate either manually or automatically in the field.

In accordance with a broad aspect of the present invention, there is provided an assembly for production of gas from a down-hole gas-producing formation to surface through a well bore lined with casing having openings through which gas can pass from the formation into the casing and the assembly being capable of periodically clearing of accumulated liquids when the pressure of produced gas is insufficient to overcome hydrostatic pressure of the accumulated liquids, the assembly comprising: a tubing string extending from surface through the casing and having a lower open end positioned below a point at which the hydrostatic pressure of accumulated liquids exceeds the formation pressure of produced gas, the tubing string having a fore sealed from fluid flow communication with the casing except through the lower open end; a means for collecting fluids passing from the casing at surface; a means for collecting fluids passing from the tubing string at surface; a check valve positioned in the casing above the openings and below the lower open end of the tubing string, the check valve permitting flow of fluids from formation through the openings to the lower end of the tubing string, but restricting reverse flow therethrough; and a means for introducing gas from a source of pressurized gas at surface to either the casing or the tubing string to create sufficiently high pressure above the accumulated liquids to push the accumulated liquids from bottom-hole up through the other of casing or the tubing string to surface and out of said well.

In accordance with another broad aspect of the present invention, there is provided a method of unloading accumulated water from a well bore to a level sufficient to permit gas to be produced from the well bore, using formation pressure, the well bore being lined with casing and having openings in the casing to permit produced gas to pass from a formation into the casing, the method comprising: providing an assembly including a tubing string extending from surface through the casing and having a lower open end positioned below a point at which the hydrostatic pressure of the accumulated liquids exceeds the pressure of produced gas, the tubing string having a bore sealed from fluid flow communication with the casing except through the lower open end; a means for collecting fluids passing from the casing at surface; a means for collecting fluids passing from the tubing string at surface; a check valve positioned in the casing below the openings and above the lower open end of the tubing string, the check valve permitting flow of fluids from the openings or perforations to the lower open end of the tubing string, but restricting the reverse flow therethrough; and a means for introducing gas from a source of pressurized gas at surface to either the casing or the tubing string; closing the check valve; introducing gas from surface to either the casing or the tubing string to create sufficiently high pressures above the accumulated liquids to push the accumulated liquids from bottom-hole up through the other of casing or tubing string to surface and out of said well bore; and stopping introduction of gas from surface to permit the well bore to return to production of gas from the formation.

The casing lines the well bore, as is known and can be standard casing or any other well bore liner. The well bore can be vertical or horizontal and can be the main well bore or laterals kicked off from a main bore hole. Where the well bore services more than one production zone, has a large internal volume or includes numerous lateral well bores, packers can be used to isolate areas into which gas is introduced to apply pressure above accumulated liquids.

In some situations, such as in a dangerous or sour gas well, or other regulated wells, or where the integrity of the casing is suspect, production may be through an internal conduit or tubing string depended or placed within the said well's original casing. The internal conduit extends downward from surface to a packer above the production formation perforations, the annulus between the casing and the internal conduit being filled with an essentially inert fluid or other substance to protect the adjacent environment from leaks in the well's casing. In such cases, the internal conduit would be considered for the purposes of this invention to be the "casing" as described in this disclosure.

The openings in the casing will generally be perforations formed through the casing and cement behind the casing, but can also be other arrangements for permitting gas to flow from the formation into the casing such as, for example, a slotted liner or screen or open hole.

The tubing string can be an existing production or production-enhancement tubing string or a string run in for the purpose of unloading accumulated water from the well. As such, the tubing can be of any desired diameter, provided fluid flow through the casing about the tubing string and through the tubing string is significantly restricted. The tubing used in the tubing string must be rigid enough so that it will not collapse due to the pressure differentials which will be present on either side of its walls.

In conventional production wells, tubing string diameters can be of various sizes and still be used in this invention. Typical diameters are ½", ¾", 1", 1¼", 1½", etc. The only requirement to operate this invention is that the tubing string's bore (if it is used as the exhaust conduit) has to be of a size that the liquids being removed do not flow down past the gas flowing up the conduit (for example, 3½" outside diameter tubing is too large if installed in a 4" inside diameter casing, as the compressed gas bubbles through the liquid, the liquid flows down past the gas, and in both instances the liquid is not produced to surface to unload the well).

The present invention will work with ½" to 2" tubing installed in a 4½" casing. Generally, it is preferred to use the tubing which is already present in most producing gas wells susceptible to becoming overloaded with water. In cases where the tubing was too large, the present invention generally works if the roles of the two conduits are reversed.

Since the level of accumulated liquids will be brought down only to the level of the lower open end of the tubing string, the lower open end of the tubing string must be positioned below a point at which the hydrostatic pressure of the accumulated liquids exceeds the pressure produced gas. Preferably, the lower end of the tubing string is positioned closely above the openings so that a maximum amount of accumulated liquids can be unloaded in each operation.

The bore of the tubing string can be sealed from communication with the casing by various configurations. One useful configuration is a seal positioned in the annulus between the casing inner wall and the exterior surface of the tubing string at the well head.

The check valve can be mounted permanently or temporarily within the casing. The check valve should be of type suitable for the nature of the well bore and casing. For example, in a vertical cased well, a check valve can be a ball-and-seat mechanism well known in the art, while in a horizontal well, the check valve can be a sprung flapper valve or similar mechanism.

The check valve can be installed either by wireline or can be attached to the lower end of the introduced tubing string, depending upon which conduit is acting as the 'casing'. If the tubing (which is acting as the casing, referred to as the "casing/tubing") has a packer isolating the casing/tubing from the well's annulus, the check valve can be installed with conventional wire-line equipment and techniques, and set at the lowest point in the casing/tubing (which is the acting casing) by setting the check valve at the lowest connection or bottom end in the casing/tubing. The (typically, coiled) inserted second tubing string would then be "landed" as close to the check valve as practical, but above the check valve which had been previously installed by wire-line within the casing/tubing at its lowest connection, above its bottom, and below the inserted tubing string.

In sweet wells, it is generally not necessary to pack-off or isolate the annulus from the casing/tubing by a packer, and in those wells, coiled tubing is used to conduct accumulated water from the well-bore to the surface, the coiled tubing carrying with it as an installed piece at its bottom, an assembly consisting of a landing cone attached to the bottom of the check valve, which in turn is attached to a slotted sleeve or similar fitting (to permit communication between the interior of the coiled tubing and the tubing-to-casing annulus through the slots, above the check valve) which is in turn attached to the lower end of the coiled tubing; a conventional slip-stop removable packer/seal (ordinarily used to seal the annulus between a fitting on the coil tubing's bottom end's circumference and the casing/tubing within which the coiled tubing is sought to be sealed) is first installed in the casing/tubing above the openings to the production formation, and the coiled tubing with its bottom assembly is lowered until the weight of the coiled tubing and its assembly rests, pressing its bottom-most landing cone into the slip stop, causing a secure seal of the casing/tubing annulus to the check valve, isolating (when the check valve is closed) the two conduits (coiled tubing's bore plus casing/tubing-to-coil tubing annulus) from the production openings.

The wire-line and coiled tubing installers are equipped with counters which indicate the length of wire or tubing inserted into any well, which indicates the depth to which the wire-line or tubing has been lowered. Those counters are generally sufficiently accurate for placement of the check valve above the openings to formation. If the check valve is lowered below those openings, the well-bore will not hold a test pressurization, in which case the check valve should be moved up (usually not more than a meter or so at a time), and retried.

If the seal of the check valve to the casing/tubing is effected by lowering the coiled tubing to rest on a slip stop packer, for example, care should be taken in the temperature of the pressurized gas which is inserted into the coiled tubing's bore to unload the well, because it has been found that insertion of chilled air (from very cold surface conditions, for example) may cause the coiled tubing to contract longitudinally enough to lift the check valve and seat assembly at its bottom off the slip stop, and to thus permit communication between the siphon arrangement above the check valve and the openings below the check valve, thus defeating the purpose of the invention.

The means of collecting fluids passing from the casing and the tubing string at surface can be a system of conduits, seals and valves and preferably includes a gas collection system including gas/liquid separators, compressors and/or containment vessels as is known in the art.

The seals between the two conduits (for example, coiled tubing inserted into a cased well) are usually accomplished using conventional coiled tubing hangers, an example of which is produced by Select Energy Systems, Inc. of Calgary, Alberta. Such hanger systems provide a composite bag through which the tubing is led, and which when compressed forms a very tight seal between the hanger's body and the tubing's exterior surface.

The means for introducing gas preferably includes conduits, seals and valves from the source of pressurized gas. In one embodiment, the source of pressurized gas is a high pressure producing gas well. In another embodiment, the source of pressurized gas is a compressor connected to the well head by a conduit. In that case, a valve is preferably provided to permit closing off the conduit to the compressor or other source of pressurized gas. It will be apparent to those skilled in the art the compressor should preferably be automatically operable without requiring attention or priming. It is desirable that the compressor be capable of extended unattended stop-and-start operation. One type of suitable compressor is very similar to the low to moderate volume but moderate to high pressure output requirements met by compressors used in filling scuba-diving tanks. The higher the volume capacity of the compressor the faster the water is evacuated. The compressor can also be of a type mounted on a truck or large vehicle. Where there is a plurality of production wells closely positioned, there can be one permanent or semi-permanent compressor or source of high pressure gas placed to service all of these wells.

The pressurized gas should preferably remain in a gaseous state at the pressures to be used. As an example, the introduced gas should not be something like pure propane, which in most circumstances at the pressures required, would be compressed into its liquid, on-gaseous state. Suitable gases for introduction are, for example, surface air or compressed natural gas from the collection pipeline at the well head or produced at a nearby well, or nitrogen or other inert gas where chemical reaction might be problematic.

Where the well is producing sweet gas at low pressures, it has been preferred to use air from atmosphere through a compressor as the pressurized fluid in the present invention. Where a well is near a source of natural gas under pressure higher than that required to unload the well and in sufficient volumes, such as a nearby producing well or pipeline, those sources can be used as the surface source of pressurized gas for insertion. Where a well is near to a source of natural gas of sufficient volume but insufficient pressure to be utilized without compression, compression may be used with such a gas source.

Ideally, the water produced by the unloading process will be produced into the collection system of separators and sales lines, and carried away from the well-site for proper disposal. The compressor used should be large enough to provide adequate volumes of pressurized gas in the required pressure ranges to produce the accumulated liquids within a reasonable period of time. Those types of compressors will be apparent to one skilled in the art. Generally, the less time spent unloading, the more time spent producing, the better.

It is to be understood that the pressure-containing capacity of well components such as well-heads, conduit, piping, joints, packers, fittings, compressors, valves, and the like, will have to be sufficiently higher than the pressures encountered during the operation of the system. It is also to be understood that all components of the assembly according to the present invention, must be suitable for use in well bore conditions, which may be corrosive, etc.

The pressurized gas can be introduced to either the casing or to the tubing string to act on the accumulated liquids. In a preferred embodiment, the gas is introduced into the casing causing liquids to be forced up through the tubing string to surface. This is preferred where the casing is large diameter and the tubing is of relatively small diameter. It is generally preferred to produce pressured gas into the conduit with the smaller cross-section, and to exhaust the liquids from the conduit with the larger cross-section.

The check valve can be closed, in one embodiment, when hydrostatic pressure caused by the accumulation of water from the production zone in the bottom of the casing above the check valve exceeds the pressure from the formation. In another embodiment, the check valve is forced to close by introducing gas from surface to increase the pressure above the check valve.

The introduction of gas from surface to force liquid out of the well can be initiated when it is determined that the check valve is closed, as will be indicated by observing the flow or produced gas from the well. When the flow of produced gas ceases, the check valve is assumed to be closed. Alternatively, the introduction of gas from surface can be initiated on a regular basis by use, for example, of a timer.

Prior to introduction of gas, the casing will be sealed to prevent escape of introduced gas and produced fluids, in order to utilize the pressure differentials, except through the conduit being used to exhaust the accumulated fluids.

The introduction of gas from surface can be continued until the introduced gas begins to be expelled after the accumulated liquids are exhausted, or for a selected period of time, regardless of whether water continues to be evacuated.

There are other situations and well configurations which those skilled in the art would consider to be equivalent to "casings" or "conduits" or "tubing strings", or to "bores" or "surface" or "collection systems" or "gas", "fluid", "valve", and the like, and such terms are to be read expansively rather than restrictively, the description here being made to inform those skilled in the art of the concept of the invention and some of its embodiments, but not so as to restrict the claims set out herein.

DETAILED DESCRIPTION OF THE INVENTION

Figure 1:
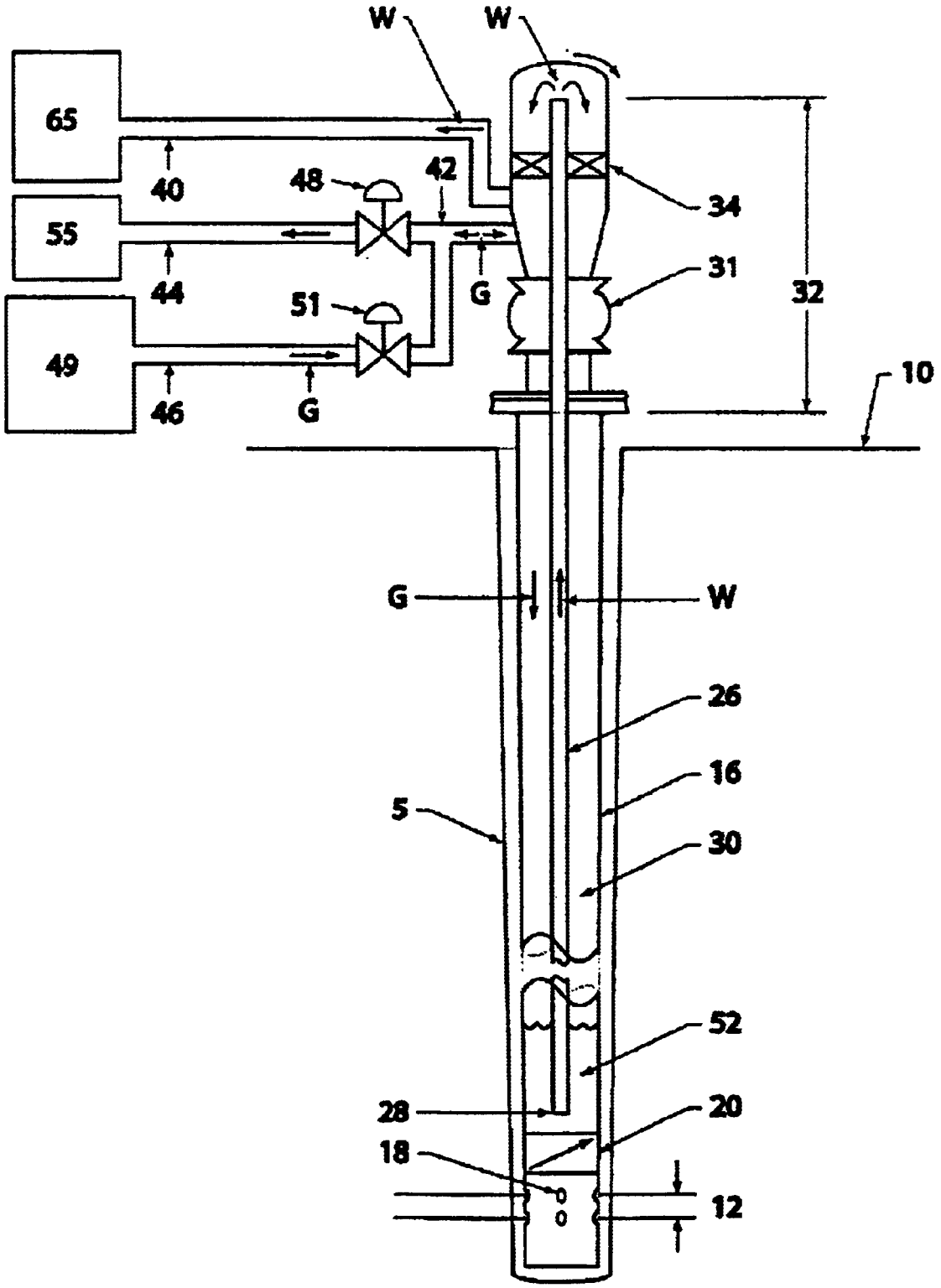
FIG. 1 is a schematic view of the apparatus and method, illustrating one embodiment of the invention.
Figure 1A:
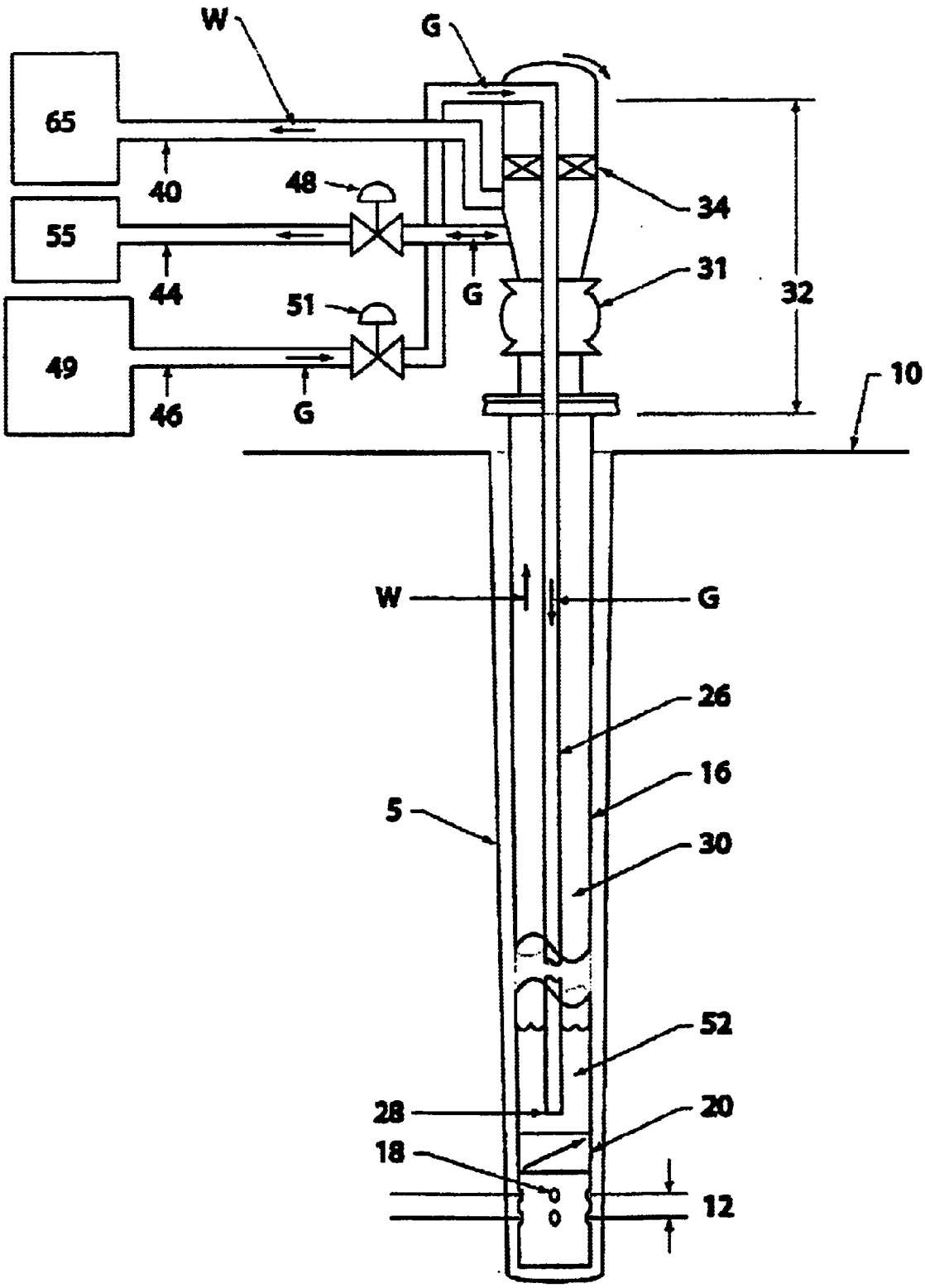
FIG. 1A is a schematic view of the apparatus and method, illustrating a second embodiment of the invention.

The following description relates to one embodiment of the invention, and is made with reference to FIG. 1, which is a stylized schematic drawing of an exemplary gas producing well, including the apparatus of the present invention. A well bore 5 containing the apparatus extends from surface 10 and passed into or through a gas-producing reservoir 12. Well bore 5 is lined with casing 16. As is known, perforations 18 are formed through casing 16 adjacent reservoir 12 to permit reservoir fluids to enter the bore of the casing. The annulus about casing 16 is filled with cement or other sealants such that migration of fluids therethrough is avoided and instead fluids pass through perforations into the casing.

A check valve 20 is installed in casing 16 above perforations 18. Valve 20 permits passage of fluids upwardly therethrough but seals against passage of fluids downwardly towards reservoir 12. The valve can be a permanent installation or can be more temporary in nature. Valve 20 can be any of various check valves such as, for example, a ball valve or a sprung flapper valve.

A tubing string 26 extends within casing 16 from surface 10 and has a lower, open end 28 positioned above check valve 20. With tubing string 26, two conduits are provided for passage of fluids from reservoir to surface. The first conduit is the annulus 30 between casing 16 and tubing 26 and the second conduit it through the inner bore of tubing string 26. Valve 20 controls the passage of fluids from the reservoir to the two conduits.

The tubing string can be a string previously run into the well for production or production-enhancement purposes or can be run in for the purpose of unloading the well bore of water. While tubing string 26 is preferably formed of standard production tubing, other tubing materials can be used. In any event, the tubing string must be able to withstand pressure differentials across its walls and must be able to support its own weight in the length required to extend from its hanger at or near surface to just above the check valve. It should be of inside diameter sufficient to efficiently move water in the required volumes within reasonable amounts of time with reasonable energy expenditures. In addition, the tubing string should have an outer diameter selected with consideration as to the casing's inside diameter to permit efficient movement of gas past the tubing string over its length. In conventional production wells, tubing string diameters can be of various sizes and still be used in this invention. Typical diameters are ½", ¾", 1", 1¼", 1½", etc. The only requirement to operate this invention is that the tubing string's bore (if it is used as the exhaust conduit) has to be of a size that the liquids being removed do not flow down past the gas flowing up the conduit (for example, 3½" outside diameter tubing is too large if installed in a 4" inside diameter casing, as the compressed gas bubbles through the liquid, the liquid flows down past the gas, and in both instances the liquid is not produced to surface to unload the well).

Lower open end 28 of the tubing string represents the lowest level to which water can be unloaded from the well. Thus the tubing string must be extended down to a level selected with consideration as to the column of water that will be left in the well and the pressure of the gas in the formation. In particular, the tubing must be low enough such that the reservoir gas pressure exceeds the hydrostatic pressure of a water column extending to lower open end 28. In one embodiment, end 28 is 0.01–3.0 meters above the check valve and the check valve is located just above, for example, 0.5–3.0 meters, the highest perforation in the casing.

A casing valve 31 is provided at well head 32 which permits closure of either or both of tubing string 26 or annulus 30. Casing valve 31 permits various of the wellhead components 32 above it to be removed, while the well is shut down.

At the well head, a seal 34 is positioned in annulus 30 to seal against the passage of fluids. This may be in the form of a coiled tubing hanger, for example. Above seal 34, tubing string 26 opens into a conduit 40 leading to a gas collection system (not shown) including gas/liquid separators, and communication to pipelines, etc. Thus, any fluids, such as gas or produced water, flowing through tubing string 26, as will be discussed hereinafter, can be passed to the collection system.

Below seal 34, a conduit 42 opens through casing 16 into annulus 30. Conduit 42 opens into two further conduits 44 and 46. Conduit 44, which can be closed by a valve 48, permits flow of gas produced through the casing annulus 30 to a gas collection system 55 including gas/liquid separators, storage facilities, compressors, access to pipelines, etc. Conduit 46 is in communication with a source 49 of pressurized gas, controlled by valve 51, and permits flow of pressurized gas therethrough to annulus 30. The source of pressured gas can be air or produced gas from a compressor or gas from a high-pressure source such as a nearby high pressure well bore. Where a gas produced by a high pressure gas well is used, no compressor will be needed. However, when using either a high pressure gas well or a compressor, various control systems must be used to ensure that gas is introduced to the well only at selected times and for selected durations or until desired results are achieved.

Seal 34 provided for separate handling of fluids from annulus 30 and fluids from tubing string 26. As will be appreciated, other means can be used in place of the seal to maintain separate fluids from these two conduits. It will also be appreciated that other conduit arrangements can be used for effectively permitting introduction and removal of gases and liquids from the well bore.

The apparatus as described may be used in the following method to dewater a gas well. When the reservoir 12 produces gas, it passed through perforations 18 and into casing 16. After passing through the check valve 20, the gas passes through annulus 30 and is collected through conduits 42 and 44. Alternately, produced gas can pass up both annulus 30 and tubing string 26 and be collected at surface therefrom. In another embodiment, tubing string can be removed during regular production and only run in for unloading of produced water, when necessary.

In some wells, water 52 is produced and may collect at the well's bottom. Eventually the water level in the well bore will attain a height such that its hydrostatic pressure impairs the production of gas from reservoir 12 using the reservoir's inherent pressure. This causes a decline or even cessation of gas flow from reservoir 12 to surface 10 for collection. In those circumstances, the apparatus described can be actuated to remove that accumulated water and other liquids.

When the apparatus is used to remove water 52, check valve 20 must be closed. The check valve can be closed by the hydrostatic pressure of water above the check valve exceeding the pressure from reservoir 12 below the check valve. Alternately, check valve 20 is closed by introduction at wellhead 32 of pressurized gas from source 49 (i.e. by closure of valve 48 and introduction of gas through conduits 46, 42). A combination of those forces can also be used to close the check valve.

Once check valve 20 is closed, pressurized gas is introduced into the casing annulus 30 from source 49, as indicated by the arrows G, which causes a pressure increase above accumulated liquid at the well's bottom. Seal 34 prevents any introduced gas from passing to conduit 40, thus all gas passes down through annulus 30. Eventually, the pressure of the introduced gas exceeds the hydrostatic pressure of the accumulated liquid 52 and the pressure of the fluid in tubing string 26 above the liquid. This causes the tubing string to behave as a siphon and the accumulated liquid 52 to be thus forced to flow as indicated by arrows W, to surface 10 and out through conduit 40 to a collection system 65.

It will be appreciated by those skilled in the art that the source of pressurized gas will be required to provide sufficient gas to fill and pressurize the sealed casing. The volume of casing to be filled is easily calculated by reference to the casing's inside diameter and its length. Preferably, sufficient gas should be available to also fill the tubing string within the casing. The gas must be eventually at a pressure greater than the hydrostatic pressure of the accumulated water, which pressure can be easily calculated by the accumulated water. Thus the pressures and volumes of gas required can be quite easily calculated using known information. For example, in a typical test well, equipped with 4½" casing and 1½" coiled tubing, and with reservoir pressure approximating 130 psi and well depth of 530 meters (1740 feet), the hydrostatic pressure of a column of water within the casing of approximately 280 feet overcame the formation production pressures, at which stage the well ceased production (280 feet of salt-laden water equates to approximately 130 psi at bottom of the column). Gas was introduced to the well into the casing and reached a pressure of up to 750 psi at its maximum (since that is the pressure induced by a 1½"

diameter column of salt-laden water 1740 feet high, being the exhaust tubing during the time when it is filled during the unloading exercise). The above numbers are approximations for ease of description, and would vary with the salinity of the produced water and the depth of the well and its formation pressure. From this example, however, it is apparent that the pressure ranges for the introduced gas can be readily calculated from known or easily obtained information at the well-site.

Gas can continue to be introduced until all of the accumulated liquid down to the level of end 28, as indicated by introduced gas exiting through conduit 40, or for a selected period of time. When a selected amount of accumulated liquid is thus evacuated to surface and out of the well, the flow of pressurized gas is stopped. The valve 48 is opened, and the pressurized gas within tubing string 26 and annulus 30 is allowed to dissipate through conduits 40 and 42 to collection systems, which typically include separators, compressors and pipelines, etc. Once the pressure of introduced gas is sufficiently dissipated and provided a sufficient amount of introduced gas is sufficiently dissipated and provided a sufficient amount of water has been removed, the check valve 20 opens and permits passage of produced gas from reservoir 12. Produced gas then continues to flow up through the casing to surface until produced water accumulates such that the check valve is again closed for water removal.

While the described route of water removal is up through the tubing string, it is to be understood that the reverse operation could be used (by altering the valve seal and pipe configuration at surface) wherein compressed gas is introduced through the tubing string to force accumulated water up through the casing annulus.

It will be apparent that the introduction of pressured gas can be initiated automatically or manually, and may be responsive to a timer, a pressure differential sensor system, a drop in production volumes which indicates an increase in accumulated liquids at bottom-hole, or other suitable indications.

A person skilled in the art will understand that when the liquid is exhausted from the casing annulus 30 above lower open end 28 of the tubing string 26, there will then be a large volume of introduced gas passing up through tubing string 26 to the collection system. In addition, there will be large volumes of introduced gas to be handled when the introduced gas is allowed to depressurize. Thus, flow control means and perhaps chemical injection means would profitably be utilized to reduce such depressurization and the commensurate temperature drops and consequent hydrate formation and other mechanical problems associated with such events.

It will be understood that various changes in the details, materials, arrangements of parts, and operating conditions which have been described and illustrated here in order to explain the nature of the invention may be made by those skilled in the art within the principles and scope of the invention, and will not derogate from or limit the scope of the claims.

What is claimed is:

1. An assembly for production of gas from a down-hole gas-producing formation to surface through a well bore lined with casing having openings through which gas can pass from the formation into the casing, the assembly capable of being periodically cleared of accumulated liquids when the pressure of produced gas is insufficient to overcome hydrostatic pressure of the accumulated liquids, the assembly comprising:

a. a tubing string extending from surface through the casing and having a lower open end positioned below a point at which the hydrostatic pressure of the accumulated liquids exceeds the pressure of produced gas, the tubing string having a bore sealed from fluid flow communication with the casing except through the lower open end;

b. a means for collecting fluids passing from the casing at surface;

c. a means for collecting fluids passing from the tubing string to surface;

d. a check valve positioned and sealed to the casing above the openings and below the lower open end of the tubing string, the check valve permitting upward flow of fluids from the openings toward the lower open end of the tubing string, but restricting reverse flow therethrough; and e. a means for introducing pressurized gas from a source at surface to either the casing or the tubing string to create sufficiently high pressures above the accumulated liquids to push the accumulated liquids from bottom-hole up through the other of the casing or the tubing string to surface and out of said well.

2. The assembly as in claim 1 wherein said tubing string is an existing tubing string placed within said casing as part of a production program.

3. The assembly in claim 1 wherein said check valve is a ball-and-seat valve.

4. The assembly in claim 1 wherein said check valve is a sprung flapper valve.

5. The assembly in claim 1 wherein the source of pressurized gas is a compressor.

6. The assembly in claim 1 wherein the introduced gas is air from atmosphere at surface.

7. The assembly in claim 1 wherein the introduced gas is gas collected at surface from the formation.

8. The assembly in claim 1 wherein the introduced gas is collected gas from another well.

9. The assembly in claim 1 wherein the means for collecting fluids passing from the casing at surface is a conduit including a valve for controlling fluid flow therethrough and connected to a gas collection system.

10. The assembly in claim 1 wherein the means for collecting fluids from the tubing string at surface is a conduit leading to a gas collection system.

11. A method of unloading accumulated water from a well bore to a level sufficient to permit gas to be produced from the well bore, well bore being lined with casing and having openings in the casing to permit produced gas to pass from a formation into the casing, the method comprising:

a. Providing an assembly including a tubing string extending from surface through the casing and having a lower open end positioned below a point at which the hydrostatic pressure of the accumulated liquids exceeds the pressure of produced gas and above a check valve, the tubing string having a bore sealed from fluid flow communication with the casing except through the lower open end; a means for collecting fluids passing from the casing at surface; a means for collecting fluids passing from the tubing string at surface; a check valve sealed to the casing above the openings and below the lower open end of the tubing string, the check valve permitting upward flow of fluids from the openings to the lower open end of the tubing string, but restricting reverse flow therethrough; and a means for introducing gas from a source of pressurized gas at surface to either the casing or the tubing string;

b. closing the check valve;

c. introducing gas from surface to either the casing or the tubing string to create sufficiently high pressures above the accumulated liquids to push the accumulated liquids from bottom-hole up through the other of casing or the tubing string to surface and out of said well bore; and d. stopping introduction of gas from surface to permit the well bore to return to production of gas from the formation.

12. The method in claim 11 wherein the step of closing the check valve is accomplished when the pressure of the accumulated liquids above the valve is greater than the pressure exerted below the valve by the formation.

13. The method in claim 11 wherein the step of closing the check valve is accomplished by introducing gas from surface such that the pressure above the check valve is greater than the pressure exerted below the valve by the formation.

14. The method in claim 11 further comprising determining when the check valve is closed by observing when the flow of produced gas has ceased.

15. The method in claim 11 wherein said accumulated liquids are forced to surface through the tubing string and out through the means for collecting fluids passing from the tubing string at surface, the means including an apparatus providing for separation of liquids from gases.

* * * * *